US008919596B2

(12) United States Patent
Carino

(10) Patent No.: US 8,919,596 B2
(45) Date of Patent: Dec. 30, 2014

(54) NO-SPILL TACKLE, TOOL OR UTILITY BOX

(76) Inventor: Brian Carino, Puyallup, WA (US)

( * ) Notice: Subject to any disclaimer, the term of this patent is extended or adjusted under 35 U.S.C. 154(b) by 0 days.

(21) Appl. No.: 13/566,487

(22) Filed: Aug. 3, 2012

(65) Prior Publication Data

US 2014/0034530 A1 Feb. 6, 2014

(51) Int. Cl.
*B65D 45/00* (2006.01)
*B65D 85/28* (2006.01)
*B65D 25/28* (2006.01)

(52) U.S. Cl.
USPC ..... 220/318; 190/118; 206/315.11; 206/373; 220/763

(58) Field of Classification Search
USPC ..... 206/315.11, 372–373; 220/318, 220/762–765; 190/115, 116, 118
See application file for complete search history.

(56) References Cited

U.S. PATENT DOCUMENTS

| | | | | | |
|---|---|---|---|---|---|
| 1,213,423 | A * | 1/1917 | Schaffer | ..... | 220/318 |
| 3,464,586 | A * | 9/1969 | Hitzeroth | ..... | 220/763 |
| 4,351,448 | A * | 9/1982 | Ingersoll et al. | ..... | 220/318 |
| 5,169,018 | A * | 12/1992 | Fiore | ..... | 220/318 |
| 5,176,281 | A * | 1/1993 | Fiore | ..... | 206/315.11 |
| 5,226,553 | A * | 7/1993 | Fiore | ..... | 220/318 |
| 6,415,786 | B1 * | 7/2002 | Kolbe et al. | ..... | 220/318 |

* cited by examiner

*Primary Examiner* — Bryon Gehman

(57) ABSTRACT

The unique element of this tackle box can also be applied to a toolbox, sewing box, or any other type of utility box used for carrying various supplies. That unique element is the handle itself and the way that it automatically secures the top lid of the box when it's being carried and in the fact that the handle itself is attached to lower portion of the box and not attached to the lid, as is the case for most prior inventions that are similar. By attaching the handle to the lower portion of the box and not the lid, this invention solves the problem that occurs when the user commonly forgets to secure the lid (as required in prior related inventions with this design flaw) resulting in accidental spillage of its contents.

4 Claims, 8 Drawing Sheets

NO-SPILL TACKLE, TOOL OR UTILITY BOX

BACKGROUND OF THE INVENTION

Field of the Invention

This invention pertains to portable containers or boxes that are used for carrying and storing a variety of items, such as fishing equipment, tools, etc. More particularly, it's designed to rectify accidental spillage of contents that are held in such containers when the user forgets to deliberately secure them by means of a sealing or latching mechanism.

Prior art in this particular field suffers from several different design flaws. In other similar types of containers, the carrying handle is attached to the container's upper lid and not to the lower portion of the container itself. In conjunction with that attribute, the container's lid ultimately needs to be secured by the use of a separate latching or buckling type of mechanism. When and if the user forgets to secure the upper lid and attempts to pick up the container, the lid opens and because the lid is typically hinged on one end of the container, this causes the container to tilt or swing open, spilling its contents.

BRIEF SUMMARY OF THE INVENTION

A tackle, tool, or general equipment box made of the main lower portion of the container, an upper lid and a handle that is mounted to the two vertical sidewalls of the lower main box. The carrying handle is attached to the lower portion of the container itself and not to the upper lid. The carrying handle secures the lid to the container in the simple, singular user action in rotating the carrying handle to its vertical carrying position.

The upright portions of the carrying handle have small, inward facing circular cups that have a sidewall to them, with part of that sidewall removed, or cut out. When the handle rotates from the back of the box towards the front, these small inward facing circular cups rotate as well and their respective sidewalls overlap, or block a protrusion that is part of the upper lid, preventing the lid from opening. Conversely, when the carrying handle is rotated from the front of the box towards the back, those circular cups rotate to a position in which the sidewall's cut out portion is then aligned with the upper lid's protrusion, which no longer blocks those protrusions, allowing the lid to open freely.

When the carrying handle is rotated as far as it can travel towards the front of the box, the cross member of the carrying handle snaps or locks into a relieved portion or slot that is integrated into the shape of the upper lid's frontward facing handle. This ensures that the lid is secure and prevents the handle from moving to another position should the container fall or be jostled accidentally. While in this position, the carrying handle also rests below the surface of the container itself, making it less susceptible to being damaged or moved to another compromising position and allowing other items to be placed on top of it.

BRIEF DESCRIPTION OF THE SEVERAL VIEWS OF THE DRAWINGS

FIG. 6 shows the handle upright (6) while in the upright carrying position. When the handle upright (6) is in this position, the circular, self-securing mechanism that's on the handle uprights (6) are rotated and over the top tab (5) that's molded to the lid itself (3). This ensures that the lid (3) cannot open. FIG. 6*a* shows the same frontal, close up view of the upper left corner of the box, but in 6*a*, the handle upright (6) is rotated towards the back of the box, away from the user. When the handle upright (6) is in this position, the circular, self-securing mechanism on the handle uprights (6) does not obstruct, or cover the top tab (5) that's molded to the lid itself (3). This allows the lid (3) to freely open.

DETAILED DESCRIPTION OF THE INVENTION

Figure 1:
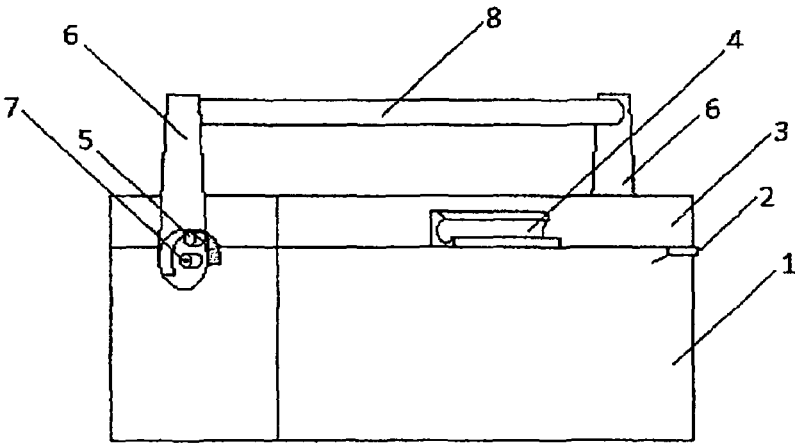
FIG. 1—This illustration shows an angled view of the box while the handle (8) is in the upright carrying position. When being carried, the circular, self-securing mechanism that's on the handle uprights (6) are rotated and over the top tab (5) that's molded to the lid itself (3). This ensures that the lid (3) cannot open.
Figure 5:
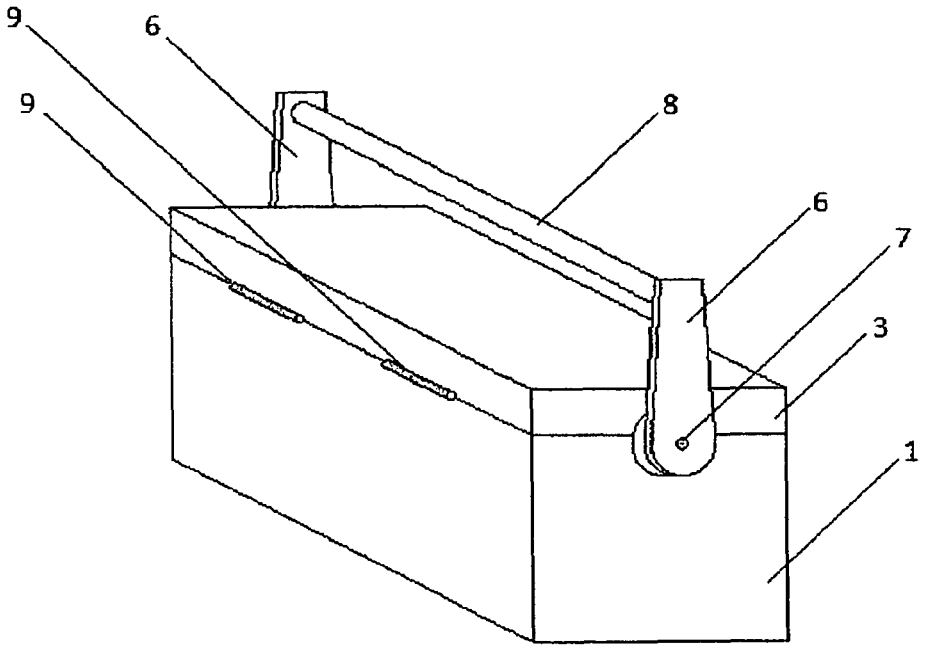
FIG. 5—This illustration shows an angled view of the rear of the box and indicates the location of the lid hinge (9).
Figure 7:
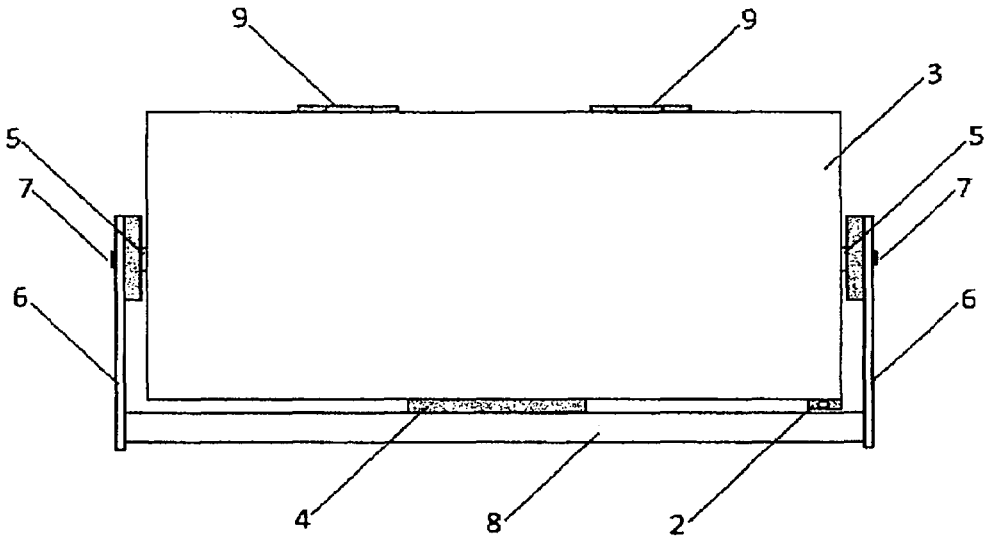
FIG. 7—This illustration shows a top view of the box while it is not being carried and the handle (8) is flipped towards the front of the box, towards the user. When the handle (8) is in this position, it snaps into the relieved portion of the lid handle (4), locking it into place. This ensures that the lid (3) is secure and that the handle (4) is also secure during the box's transit or storage. This illustration also more prominently displays the padlock eyelet (2) that is used to secure the box from theft.
Figure 8:
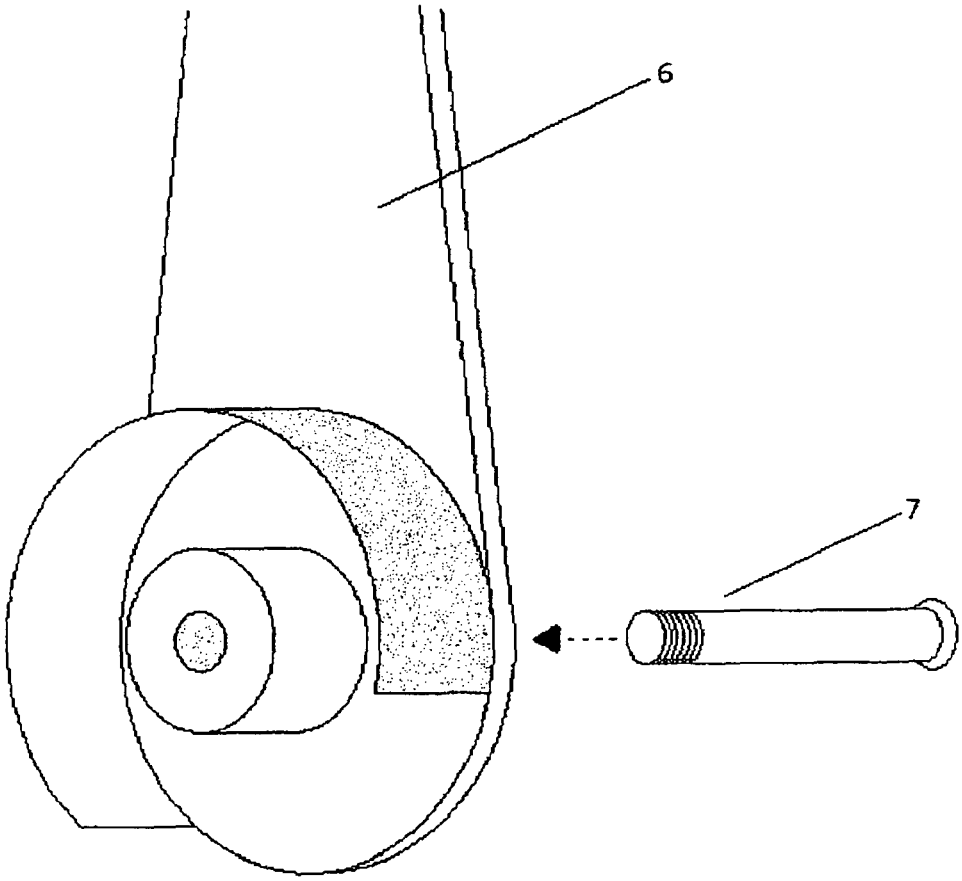
FIG. 8—This illustration shows a close up, inner view of the handle upright (6) and the bolt (7) or fastener that secures it to the box.

In reference to FIG. 1, the illustrated tackle, tool or utility box comprises of a lower compartment made of four vertical panels and one bottom panel 1, an upper lid made of four vertical panels and one top panel and a lid handle 4 that is attached to the said upper lid 3. The upper lid 3 also has cylindrical protrusions 5 on the left and right sides that are fastened to the sides of the upper lid 3, a carrying handle made up of two upright arms 6 and a joining cross member 8. The upright arms 6 have integrated, inward facing circular shaped cups, in which a majority of the cups is relieved, leaving a partial outer sidewall of the cup and a center raised cylindrical section also. These carrying handle uprights 6 are secured to the sides of the lower box 1 by means of a fastener 7. FIG. 7 shows a small tab 2 that would be located on the right front of the lower box 1. It would have a vertical hole through it to allow the use of a general padlock to further secure the box's contents. FIGS. 5 & 7 show the rear portion of the box just to illustrate the fact that the upper lid 3 is attached to the lower portion of the box 1 by means of standard door type hinges 9.

Figure 6:
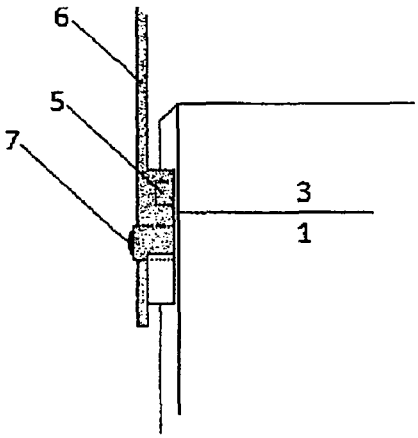
FIGS. 6 & 6*a*—This illustration shows a frontal, close up view of the upper left corner of the box.
Figure 6A:
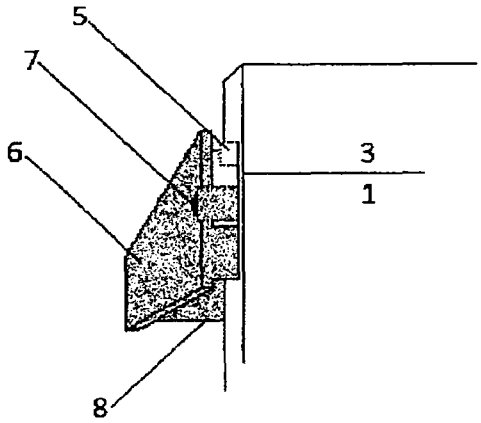

This invention was designed to prevent the accidental spillage of contents caused by the user forgetting to secure the upper lid to the lower portion of the box and then lifting up on the handle of a box that's designed in a way in which the carrying handle is attached to the lid and not the lower portion of the box itself. In FIG. 1, you see how the design makes it impossible for the upper lid 3 to open when the user lifts up the handle 6 & 8 and carries the box. This is because when the user lifts up the carrying handle, the upright portions of the carrying handle 6 rotate and the sidewall portion of those circular cups 6 roll over the tops of the cylindrical protrusions 5 on the sides of the upper lid 3. FIGS. 6 & 6*a* show this in better detail. Again, in FIGS. 1, 6 & 6*a* and 7, the handle is in the upright carrying position and you can clearly see how the sidewalls of the inward facing circular cups on the handle uprights 6 cover the upper lid's cylindrical protrusions 5 and thus prevent the lid 3 from moving vertically and opening.

Figure 2:
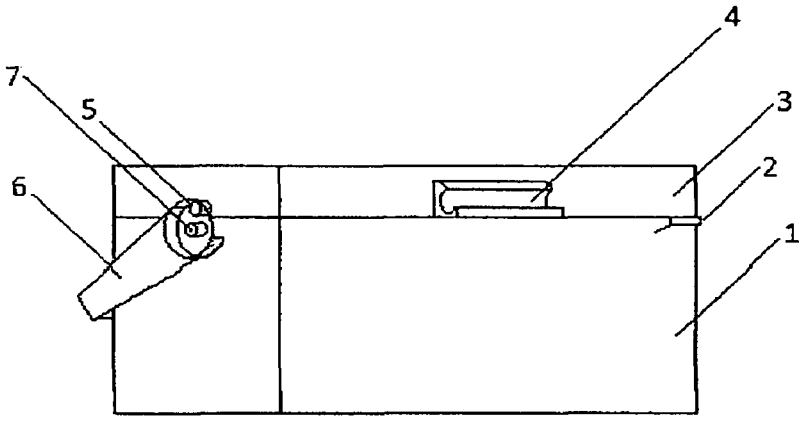
FIG. 2—This illustration shows an angled view of the box while it is not being carried and the handle (8) is flipped towards the back of the box, away from the user. When the handle (8) is in this position, the circular, self-securing mechanism on the handle uprights (6) does not obstruct, or cover the top tab (5) that's molded to the lid itself (3). This allows the lid (3) to freely open.
Figure 4:
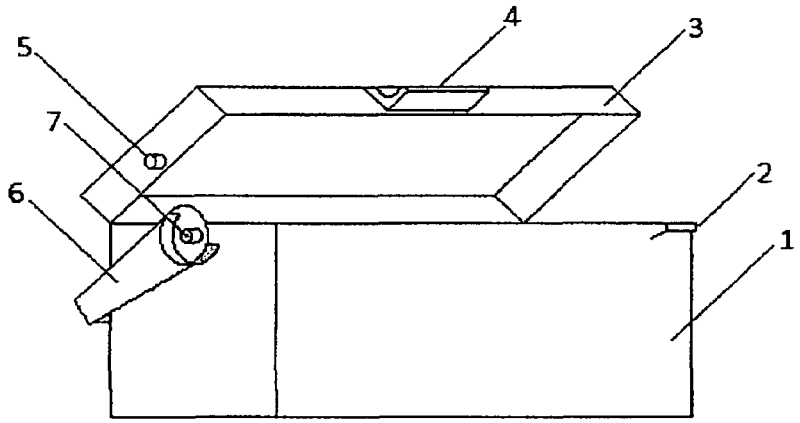
FIG. 4—This illustration shows an angled view of the box with the lid (3) in the opened position. The lid (3) is fixed to the back of the box by standard door hinges (9) (see FIG. 5). The lid (3) is able to be opened in this way because the handle is flipped counter-clockwise towards the back of the box, away from the user. When the handle is in this position, the circular, self-securing mechanism on the handle uprights (6) does not obstruct, or cover the top tab (5) that's molded to the lid itself (3), again, allowing the lid (3) to freely open.

When the carrying handle 6 & 8 is in the position illustrated in FIGS. 2 & 4, you can see that once the carrying handle 6 & 8 is rotated towards the back of the box, the circular cups rotate to a position in which the relieved portion of the cup's sidewalk 6 are in alignment with the upper lid's 3 cylindrical protrusions 5, thus allowing the protrusions 5 to move vertically, letting the lid 3 open freely. It should be noted that for the sake of simplicity on behalf of the user's operation of opening the upper lid 3, the carrying handle 6 & 8 rotate in the same direction as the upper lid 3 does, that being from the front of the box towards the back.

Figure 3:
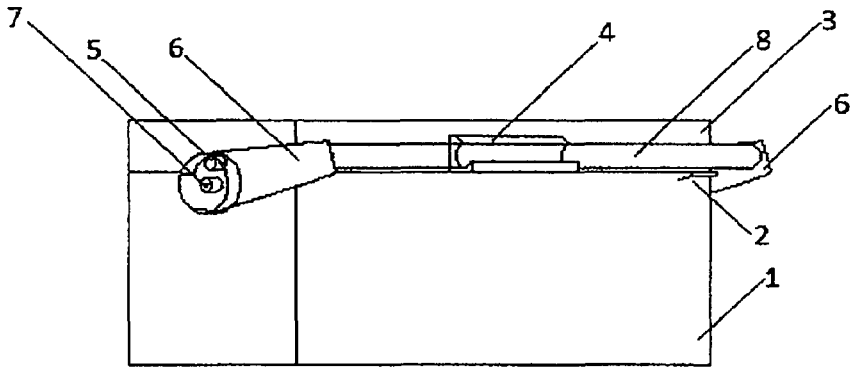
FIG. 3—This illustration shows an angled view of the box while it is not being carried and the handle (8) is flipped towards the front of the box, towards the user. When the handle (8) is in this position, the circular, self-securing mechanism that's on the handle uprights (6) are rotated and over the top tab (5) that's molded to the lid itself (3). This ensures that the lid (3) cannot open. This illustration also shows the way that the handle (8) snaps into the relieved portion of the lid handle (4), locking it into place. This ensures that the lid (3) is secure and that the handle (4) is also secure during the box's transit or storage.

When the carrying handle 6 & 8 is in the transport position as illustrated in FIGS. 3 & 7, in the carrying position, the sidewall portion of those circular cups 6 roll over the tops of the cylindrical protrusions 5 on the sides of the upper lid 3, securing the upper lid and preventing it from opening. An added feature that is shown while the carrying handle 6 & 8 is in this position however, is that the carrying handle's cross member portion 8 also snaps into the relieved portion of the upper lid's handle 4. It does so and remains firmly in this secure position because of a tight friction fitment, combined with the slight flexion property of the handle's cross member 8. Also, while the carrying handle 6 & 8 is in this storage position, it sits below the surface of the upper lid 3, allowing the user to stack other objects on top of it.

The invention claimed is:

1. A multipurpose tackle, tool or utility box comprising a five-sided enclosure including a bottom and four upstanding sides and a corresponding five-sided upper lid including a top side and four downward-extending sides, the upper lid being hinged to one said side of the enclosure, a horizontal carrying handle with arms perpendicular to the handle that each have inward-facing circular cups rotationally mounted to opposing left and right said sides of said enclosure, protrusions on corresponding left and right said sides of said upper lid are one of covered by means of said circular cups to secure the upper lid in a closed position and alternatively unobstructed by other means of said circular cups to allow opening of the upper lid when the carrying handle is rotated to alternative positions, a front handle disposed on a front side of said upper lid, the front handle structured as a receptacle to receive said carrying handle below the top side of the upper lid and above a top plane defined by tops of the four upstanding sides, the carrying handle when received in the receptacle serving to keep said carrying handle firmly in place within the receptacle to lock the box in the closed position.

2. The box as defined in claim 1, wherein the protrusions of upper lid are held down by respective sidewalls of the circular cups.

3. The box as defined in claim 2 wherein the circular cups each have a portion of their respective sidewall that is cutaway so that the protrusions may pass through the circular cups when the carrying handle is in the upper lid opening position.

4. The box as defined in claim 1 wherein the front handle has a horizontally cylindrical relieved section in which the carrying handle locks into.

* * * * *